US008889605B2

(12) United States Patent
Horng et al.

(10) Patent No.: US 8,889,605 B2
(45) Date of Patent: Nov. 18, 2014

(54) STRAW BIOLUBRICANT

(75) Inventors: Jeng-Haur Horng, Huwei Township, Yunlin County (TW); Shou-Yin Yang, Huwei Township, Yunlin County (TW); Chun-Chia Tien, Huwei Township, Yunlin County (TW); Wei-Jhuh Wu, Huwei Township, Yunlin County (TW); Hsiang-Jung Cheng, Huwei Township, Yunlin County (TW)

(73) Assignee: National Formosa University, Yunlin County (TW)

( * ) Notice: Subject to any disclaimer, the term of this patent is extended or adjusted under 35 U.S.C. 154(b) by 298 days.

(21) Appl. No.: 13/463,888

(22) Filed: May 4, 2012

(65) Prior Publication Data

US 2013/0296205 A1 Nov. 7, 2013

(51) Int. Cl.

| | |
|---|---|
| ***C10M 109/00*** | (2006.01) |
| ***C10M 111/06*** | (2006.01) |
| ***C10M 129/76*** | (2006.01) |

(52) U.S. Cl.

CPC ..... *C10M 109/00* (2013.01); *C10N 2230/06* (2013.01); *C10M 2207/283* (2013.01); *C10M 111/06* (2013.01); *C10M 2203/1006* (2013.01); *C10M 2207/289* (2013.01)

USPC ..... 508/110; 508/501; 508/216

(58) Field of Classification Search

USPC ..... 508/216, 110, 501

See application file for complete search history.

(56) References Cited

U.S. PATENT DOCUMENTS

| | | | |
|---|---|---|---|
| 7,815,694 | B2 | 10/2010 | Miller |
| 8,124,572 | B2 | 2/2012 | Miller |
| 8,168,571 | B2 | 5/2012 | Daute |

OTHER PUBLICATIONS

Hu, X., Xu, Y., Wang, Q., Zhu, X., Tribological Performance of Biomass-Oil from Straw Product, Extended Abstract, Proceedings of CIST2008 & ITS-IFToMM2008, Beijing, China.*

Lu, Q., Zhang, Z.-B., Liao, H-T., Yang, X.-C., Dong, C.-Q., Lubrication Properties of Bio-Oil and Its Emulsions with Diesel Oil, Energies, 2012, 5, 741-751.*

* cited by examiner

*Primary Examiner* — James Goloboy

(74) *Attorney, Agent, or Firm* — Alan Kamrath; Kamrath IP Lawfirm, P.A.

(57) ABSTRACT

A straw biolubricant includes 70-80% mineral oil, 6-11% straw biomass oil, and 15-20% active agent. The active agent is sorbitol oleate. The straw biolubricant includes a higher contact resistance and lower coefficient of friction in comparison with a conventional lubricant, therefore to reduce the temperature of operating machine parts.

8 Claims, 3 Drawing Sheets

STRAW BIOLUBRICANT

BACKGROUND OF THE INVENTION

1. Field of the Invention

The present invention relates to a lubricant and, particularly, to a straw biolubricant comprising straw biomass oil.

2. Description of the Related Art

Conventional lubricant comprises mineral oil and additives, including anti-foaming agents, dispersants, antioxidants, cleaning agents and rust inhibitors. Conventional lubricant is used on various machines, such as engines of vehicles, in order to prevent machine parts from being attrite and to prolong the service life of the machine parts.

The conventional lubricant comprises a significant amount of mineral oil, being a distillate of petroleum. The mineral oil in the conventional lubricant properly maintains a viscosity of the conventional lubricant, and thus, it is sufficient to form a thick oil film on a moving interface of the machine parts for avoiding possible collision. However, the viscosity of the conventional lubricant also increases the coefficient of friction (COF) of the conventional lubricant, leading to an increase of the temperature on the engines of vehicles due to additional heat generated by excessive friction on machine parts. Accordingly, the conventional lubricant has trouble resulting in abrasion of the machine parts and reducing the service life of the machine, if machine parts regularly work under a high temperature. Furthermore, the conventional lubricant has high consumption.

In additional, mineral oil in waste conventional lubricants will contaminate ground and water resources, resulting in damage to the growth of living organisms, such as plants and aquatics, and even leading to death of those living organisms. Also, the additives in the waste conventional lubricant usually have a chemical poison, which increases incidents to various diseases on humans due to minutely exposure to noxious gas comprising the additives.

Hence, there is a need for an improvement over conventional lubricants by lowering the coefficient of friction, as well as the chemical poisons therein.

SUMMARY OF THE INVENTION

The primary objective of this invention is to provide a straw biolubricant which has a low coefficient of friction, and which is eco-friendly by being frugal in fuel use.

The secondary objective of this invention is to provide a straw biolubricant which can reduce heat generated from operating machine parts and which can prolong the service life of machine parts.

Another objective of this invention is to provide a straw biolubricant which increases the contact resistance thereof, so that the thickness of an oil film is increased to avoid the abrasion of the machine parts.

An embodiment of the present invention relates to a straw biolubricant comprising 70-80% Mineral oil, 6-11% straw biomass oil, and 15-20% active agent, and particularly, to a straw biolubricant comprising 78% mineral oil, 8% straw biomass oil and 18% active agent. The active agent is sorbitol oleate. The straw biomass oil is obtained by extracting waste straw or by thermochemical decomposing waste straw via pyrolysis, and the mineral oil is machine oil, white oil, or paraffin oil.

Further scope of the applicability of the present invention will become apparent from the detailed description given hereinafter. However, it should be understood that the detailed description and specific examples, while indicating preferable embodiments of the invention, are given by way of illustration only, since variances will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

In the various figures of the drawings, the same numerals designate the same or similar parts.

DETAILED DESCRIPTION OF THE INVENTION

Figure 1:
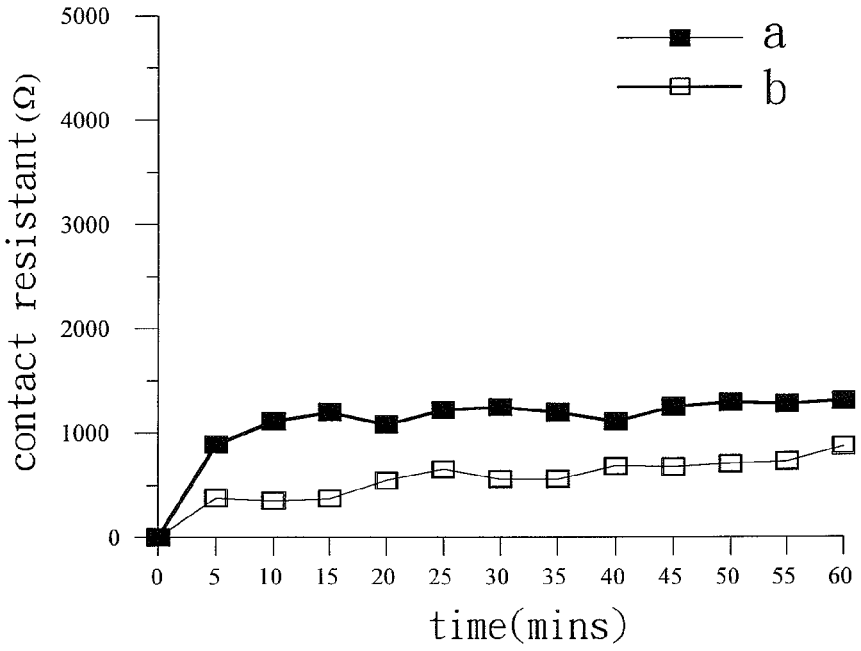
FIG. 1 is a line chart illustrating the contact resistance of a conventional lubricant and the straw biolubricant of the present invention.

The straw biolubricant of an embodiment of the present invention comprises 70-80% mineral oil, 6-11% straw biomass oil, and 15-20% active agent. The mineral oil can be machine oil, white oil, or paraffin oil. The straw biomass oil in the straw biolubricant is extracted from straw or waste straw, especially by thermochemical decomposing waste straw via pyrolysis. The active agent in the straw biolubricant can be any additive having solubilized effects, and preferably being sorbitol oleate in a preferable embodiment of the present invention, to the completed mix with the straw biomass oil and to improve the composition between the straw biomass oil and the mineral oil.

The straw biolubricant of the embodiment of the present invention comprises a straw biomass oil being a replacement of mineral oil of conventional lubricants. The straw biomass oil is less viscous under a high temperature in comparison with conventional lubricants, since the straw biomass oil does not have saturated lipid hydrocarbons (namely aliphatic hydrocarbons) and unsaturated lipid hydrocarbons. With such treatments, as applying to machines, the straw biolubricant of the embodiment of the present invention will comprise a lower coefficient of friction under a high temperature, and also is capable of increasing the contact resistance to increase the thickness of the oil film, so that it is beneficial in avoiding the abrasion of machine parts, especially after a long-term of working period, and in improving the output power of the machine parts. Furthermore, with the performance of the straw biolubricant of the embodiment of the present invention, it is sufficient to decrease heat of the machine parts generated by excessive friction on the machine parts, to prevent the machine parts from working at a high temperature and to prolong the service life thereof.

Additionally, applying to various engines of vehicles, the straw biolubricant can further reduce fuel consumption of those engines, avoiding over-depletion of fuel and environmental pollution. In this way, the straw biolubricant of the embodiment of the present invention not only can reduce contamination of ground, air and water resources caused by the conventional lubricant, but also can achieve energy conservation and environmental protection.

In a preferable embodiment of the present invention, a straw biolubricant comprising 74% mineral oil, 8% straw biomass oil, and 18% sorbitol oleate is prepared, and which has a preferable viscosity as listed in TABLE 1.

TABLE 1

Viscosity of the Straw Biolubricant of the Present Invention

| | Straw Biolubricant | |
|---|---|---|
| Temperature (° C.) | 40 | 100 |
| Viscosity (cSt) | 64 | 7.11 |

According to TABLE 1, it is noted that the viscosity of the straw biolubricant is significantly improved at a high or low temperature by adding the straw biomass oil.

For showing the benefits of the straw biolubricant of the preferable embodiment of the present invention, it is applied to a parallel friction tester to carry out a wearing test, by demonstrating and recording the contact resistance and the coefficient of friction (COF) of a conventional lubricant and the straw biolubricant of the preferable embodiment of the present embodiment, and also the temperature of machine parts under a constant load of 60 N, and various rotational rates.

Figure 2:
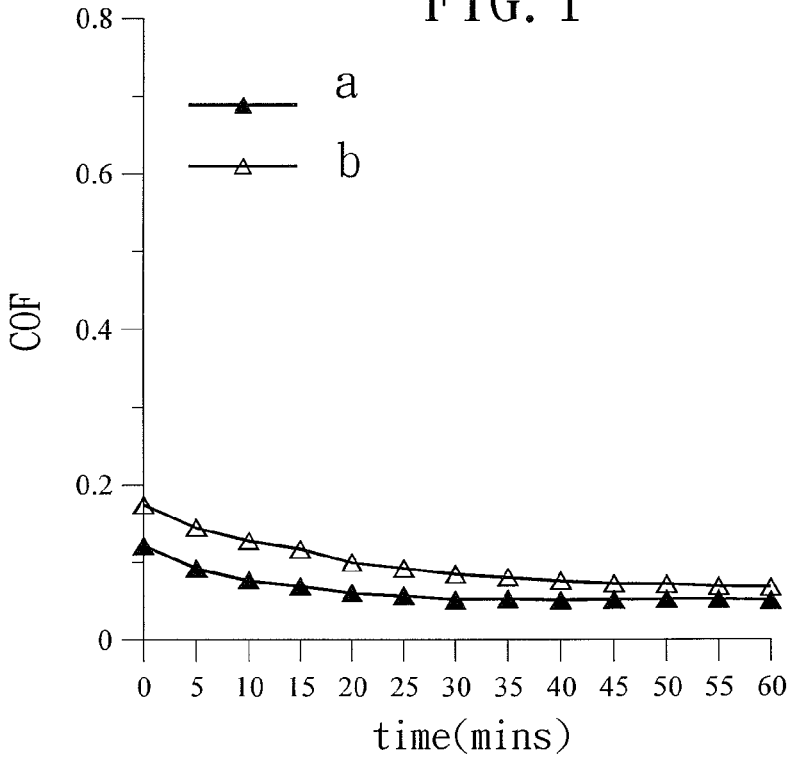
FIG. 2 is a line chart illustrating the coefficient of friction of a conventional lubricant and the straw biolubricant of the present invention.
Figure 3:
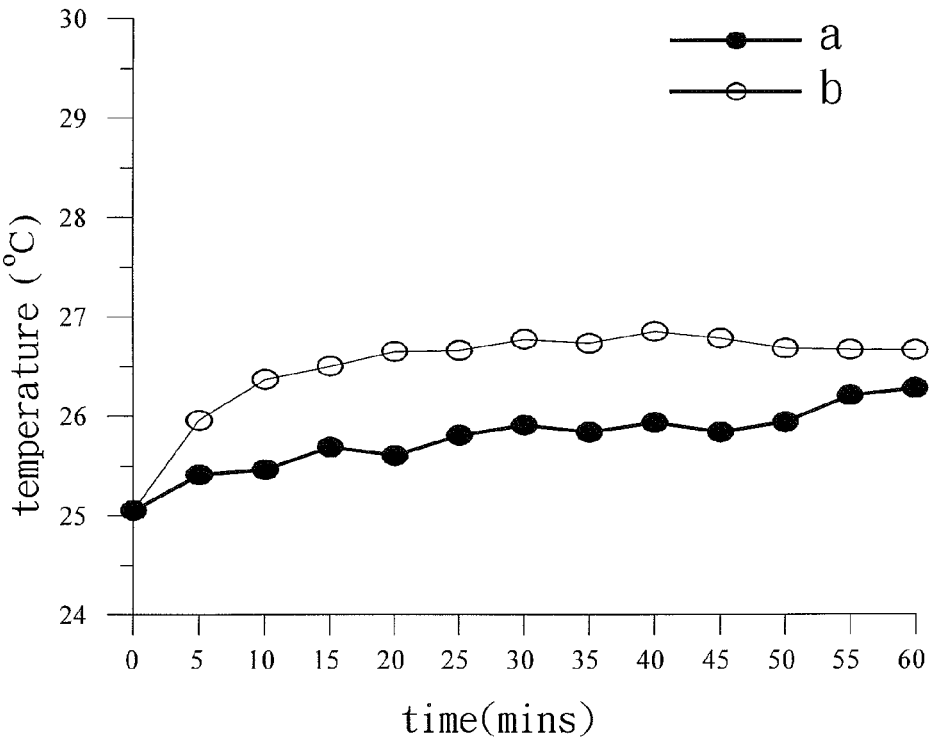
FIG. 3 is a line chart illustrating the temperature of machine parts that use a conventional lubricant and the straw biolubricant of the present invention.

With reference to FIGS. 1 to 3, the contact resistance and the COF of the conventional lubricant and the straw biolubricant of the preferable embodiment of the present embodiment, and the temperature of machine parts under 60 N (load) and 80 rpm (0.14 m/s) are illustrated respectively. In FIG. 1, it is shown that the contact resistance of the straw biolubricant of the preferable embodiment of the present embodiment (line a) is dramatically higher than that of the conventional lubricant (line b) with the load being 60 N. The straw biolubricant of the preferable embodiment of the present invention is capable of forming a thicker oil film on machine parts in comparison with the conventional lubricant, effectively avoiding the abrasion of the operating machine parts.

Also, FIGS. 2 and 3 indicate that, although the COF of the conventional lubricant decreases by time (line b), it is still higher that that of the straw biolubricant of the preferable embodiment of the present embodiment (line a). Next, turning to FIG. 3, the temperature of the machine parts that use the straw biolubricant of the preferable embodiment of the present embodiment (line a) is lower than the conventional lubricant (line b), in accordance with the smaller COF of the straw biolubricant of the preferable embodiment of the present invention. The straw billubricant of the preferable embodiment of the present invention decreases heat generated by excessive friction on machine parts, to prolong the service life of the machine parts.

Figure 4:
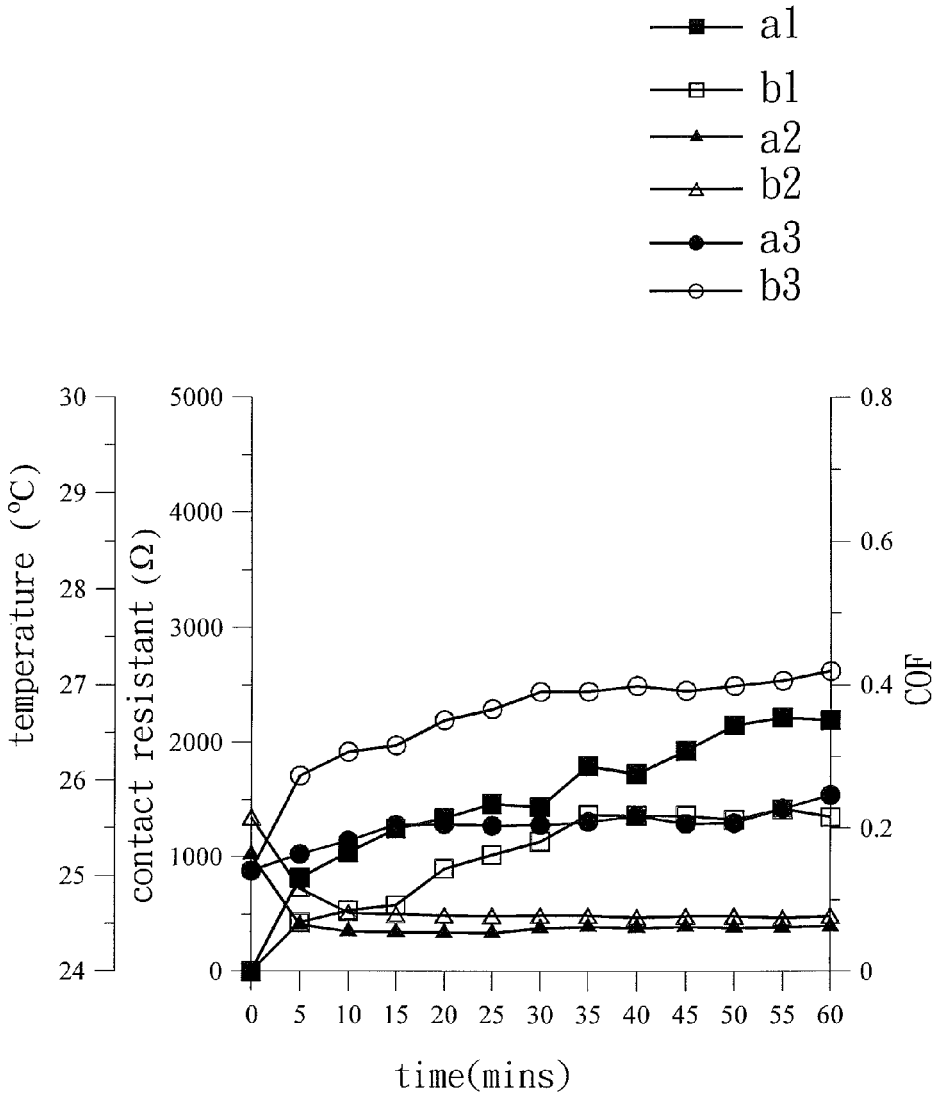
FIG. 4 is a line chart illustrating the contact resistance and the COF of the conventional lubricant and the straw biolubricant of the present embodiment, and the temperature of machine parts.

FIG. 4 shows the contact resistance and the COF of the conventional lubricant and the straw biolubricant of the present embodiment, and the temperature of machine parts under 60 N (load) and 160 rpm (0.27 m/s). In FIG. 4, the contact resistance, the COF of the straw biolubricant of the present embodiment, and the temperature of the machine parts that used the straw biolubricant of the present embodiment are illustrated by line a1, a2 and a3 respectively. Yet, the contact resistance, the COF of the conventional lubricant, and the temperature of the machine parts that used the conventional lubricant are illustrated by line b1, b2 and b3 individually. Data of FIG. 4 is similar to that of FIGS. 1 to 3, with the contact resistance of the straw biolubricant of the present embodiment being higher than that of the conventional lubricant, and with the COF and the temperature of machine parts being lower than that of the conventional lubricant.

Through the present invention, the straw biolubricant is beneficial to lower COF, to improve output power, and to avoid the loss of fuel. Furthermore, the straw biolubricant of the present embodiment can reduce heat of the machine parts generated by excessive friction, can prolong the service life of the machine parts, and can also avoid the abrasion of the operating machine parts by forming a thick oil film thereon.

Although the invention has been described in detail with reference to its presently preferred embodiments, it will be understood by one of ordinary skill in the art that various modifications can be made without departing from the spirit and the scope of the invention, as set forth in the appended claims.

What is claimed is:

1. A straw biolubricant, comprising:

70-80% mineral oil;

6-11% straw biomass oil; and 15-20% active agent effective for solubilizing the mineral oil, straw biomass oil, and the active agent.

2. The straw biolubricant as defined in claim 1, wherein the active agent is sorbitol oleate.

3. The straw biolubricant as defined in claim 1, wherein the straw biomass oil is extracted from straw.

4. The straw biolubricant as defined in claim 1, wherein the straw biomass oil is obtained by thermochemically decomposing straw.

5. The straw biolubricant as defined in claim 1, wherein the mineral oil is machine oil, white oil, or paraffin oil.

6. The straw biolubricant as defined in claim 1, wherein the straw biolubricant comprises 74% mineral oil.

7. The straw biolubricant as defined in claim 1, wherein the straw biolubricant comprises 8% straw biomass oil.

8. The straw biolubricant as defined in claim 1, wherein the straw biolubricant comprises 18% active agent.

* * * * *